US005107799A

United States Patent [19]

Wada

[11] Patent Number: 5,107,799

[45] Date of Patent: Apr. 28, 1992

[54] ENGINE INTAKE STRUCTURE

[75] Inventor: Manabu Wada, Shizuoka, Japan

[73] Assignee: Suzuki Motor Corporation, Shizuoka, Japan

[21] Appl. No.: 743,869

[22] Filed: Aug. 12, 1991

[30] Foreign Application Priority Data

Sep. 17, 1990 [JP] Japan ..... 2-246736

[51] Int. Cl.[5] ..... F02M 35/10

[52] U.S. Cl. ..... 123/52 M

[58] Field of Search ..... 123/52 M, 52 MV, 52 MC, 123/52 MB, 52 ML, 336, 337, 403

[56] References Cited

U.S. PATENT DOCUMENTS

| | | | |
|---|---|---|---|
| 4,848,280 | 7/1989 | Ohtsuka et al. | 123/52 MC |
| 4,957,071 | 9/1990 | Matsuo et al. | 123/52 MV |
| 5,012,770 | 5/1991 | Okamoto et al. | 123/52 MC |
| 5,012,771 | 5/1991 | Oda et al. | 123/52 MC |

FOREIGN PATENT DOCUMENTS

| | | | |
|---|---|---|---|
| 663379 | 5/1963 | Canada | 123/52 MV |
| 0344706 | 12/1989 | European Pat. Off. | 123/52 M |
| 61-49161 | 3/1986 | Japan . | |
| 63-45058 | 3/1988 | Japan . | |
| 0091417 | 3/1990 | Japan | 123/52 M |

*Primary Examiner*—David A. Okonsky

*Attorney, Agent, or Firm*—Flynn, Thiel, Boutell & Tanis

[57] ABSTRACT

An engine intake structure of a vertical engine disposed below an engine compartment hood of a vehicle in which the throttle body is inclined relative to the longitudinal and lateral axes of the vehicle so that the distance between the hood and the acceleration cable bracket and the distance between the hood and the throttle body are substantially equal to each other.

2 Claims, 4 Drawing Sheets

ENGINE INTAKE STRUCTURE

FIELD OF THE INVENTION

This invention is concerned with an improved engine intake structure. More particularly, it relates to an improved engine intake structure for a vertical engine, wherein the engine intake structure has a throttle body that communicates with the engine through an intake manifold and a surge tank.

DESCRIPTION OF THE PRIOR ART

Intake and exhaust manifolds are separately connected to an internal combustion engine. A surge tank, a throttle body, and an air cleaner are connected, in series, to the upstream side of the intake manifold of the inlet system.

Japanese Unexamined Patent Publication No. 49161/1986 discloses an engine intake structure. According to this publication, the top of a surge tank equipped inside an engine is inclined toward the output shaft from one end to the other. A separate suction passage connected to the surge tank is also inclined toward the output shaft. Another suction passage is connected to a lower level of the surge tank and is more inclined to move down the connection of the surge tank. In this way, the capacity of the surge tank as well as the length of a suction pipe downstream of the surge tank can be fully maintained.

Japanese Unexamined Utility Model Publication No. 45058/1988 also discloses another engine intake structure. The suction device for engines described in this publication includes suction pipes for supplying charges to cylinders inside an engine body. In reference to the cross-section of the suction pipe, the part of a pipe wall facing toward the direction of the vibrations caused by running the engine has a greater thickness than the rest of the pipe wall.

In addition, in a conventional engine intake structure, as illustrated in FIGS. 5 and 6, an intake manifold 118 is connected to the upstream side of an engine 104, as shown in FIGS. 5 and 6. An exhaust manifold (not shown) is also connected to the downstream side of the engine 104. A surge tank 120 is attached to a collecting portion of the upstream side of the intake manifold 118. A throttle body 122 is attached to the surge tank 120.

As shown in FIGS. 5 and 6, in a conventional engine intake structure, the throttle body 122 is disposed in a substantially horizontal position both longitudinally (front to back) and laterally (side to side) of the vehicle.

This results in a problem in that when the suction passage (not shown) of the throttle body 122 is located relative to the lateral axis of the vehicle (not shown), a satisfactory length of the suction passage (not shown) cannot be obtained.

To avoid producing this problem, there is a way of placing the surge tank at a higher level on the throttle body. In doing so, however, the acceleration cable bracket attached to the throttle body comes close to the engine compartment hood. This in turn causes the problem that the required clearance between the hood and the acceleration cable bracket cannot be provided.

To solve this problem, there is a method of raising the vehicle hood or lowering the position in which the surge tank is installed. However, when the installation position of the surge tank is moved downwardly, other problems occur, including:

interference between the suction passage and an engine head cover makes it difficult to lay out an inlet system;

ventilation resistance increases; and required clearances between components cannot be provided.

To solve the foregoing problems, an object of the invention is to provide an engine intake structure in which:

the throttle body is inclined relative to the longitudinal and lateral axes of the vehicle;

this is done to allow the distance between the vehicle hood and the acceleration cable bracket to be substantially equal to the distance between the vehicle hood and the throttle body;

in this way, the distance between the vehicle hood and the throttle body can be fully provided without changing the positions of the vehicle hood and the surge tank; and a satisfactory length of the suction passage in the throttle body can also be obtained.

SUMMARY OF THE INVENTION

According to the invention, there is provided an engine intake structure for a vertical engine disposed below the hood of a vehicle. A throttle body is installed to communicate with the engine through an intake manifold and a surge tank. An acceleration cable bracket is attached to the throttle body, protruding from the side of it. The engine intake structure is characterized by the features that the throttle body is inclined relative to the longitudinal and lateral axes of the vehicle, and this is done to allow the distance between the vehicle hood and the acceleration cable bracket to be substantially equal to the distance between the vehicle hood and the throttle body.

With the configuration as described above, the throttle body is inclined downwardly relative to the horizontal in the lengthwise direction of the vehicle when the engine is installed in the vehicle. The throttle body is also inclined downwardly, relative to the horizontal in the crosswise direction of the vehicle. In this way, the distance between the engine compartment hood and the acceleration cable bracket and the distance between the hood and the throttle body are substantially equal to one another.

BRIEF DESCRIPTION OF THE DRAWINGS

FIGS. 1 to 4 illustrate embodiments of the invention wherein:

FIG. 1 is a schematic side view showing the configuration of the intake structure;

FIG. 2 is a schematic end view showing the intake structure;

FIG. 3 is a side view of the engine;

FIG. 4 is a front view of the engine;

DESCRIPTION OF PREFERRED EMBODIMENT

A preferred embodiment of the invention will be described below in detail with reference to the accompanying drawings.

Figure 1:
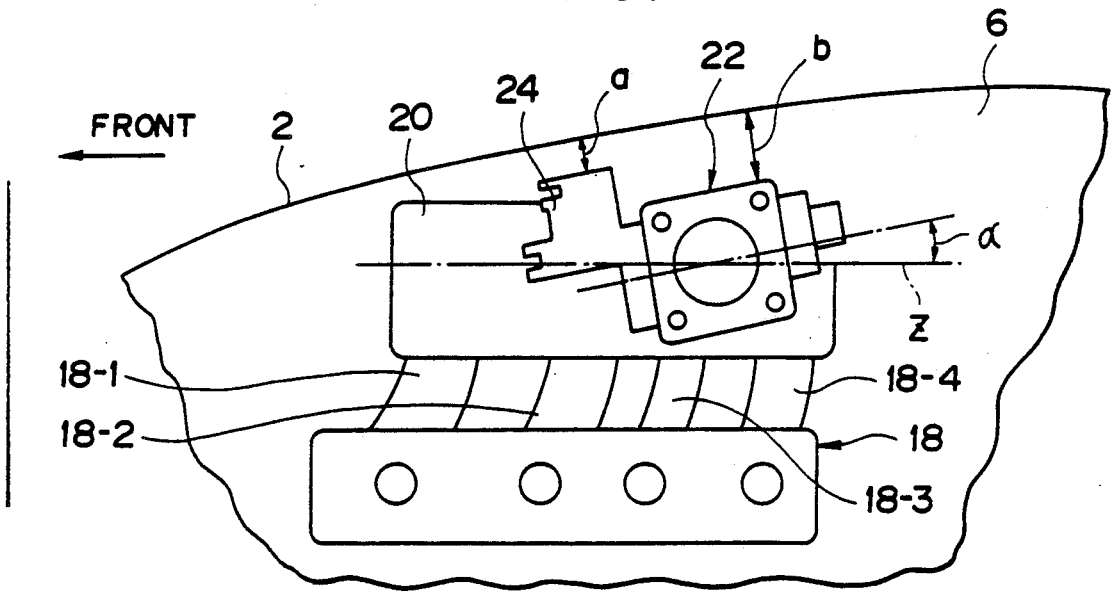
Figure 2:
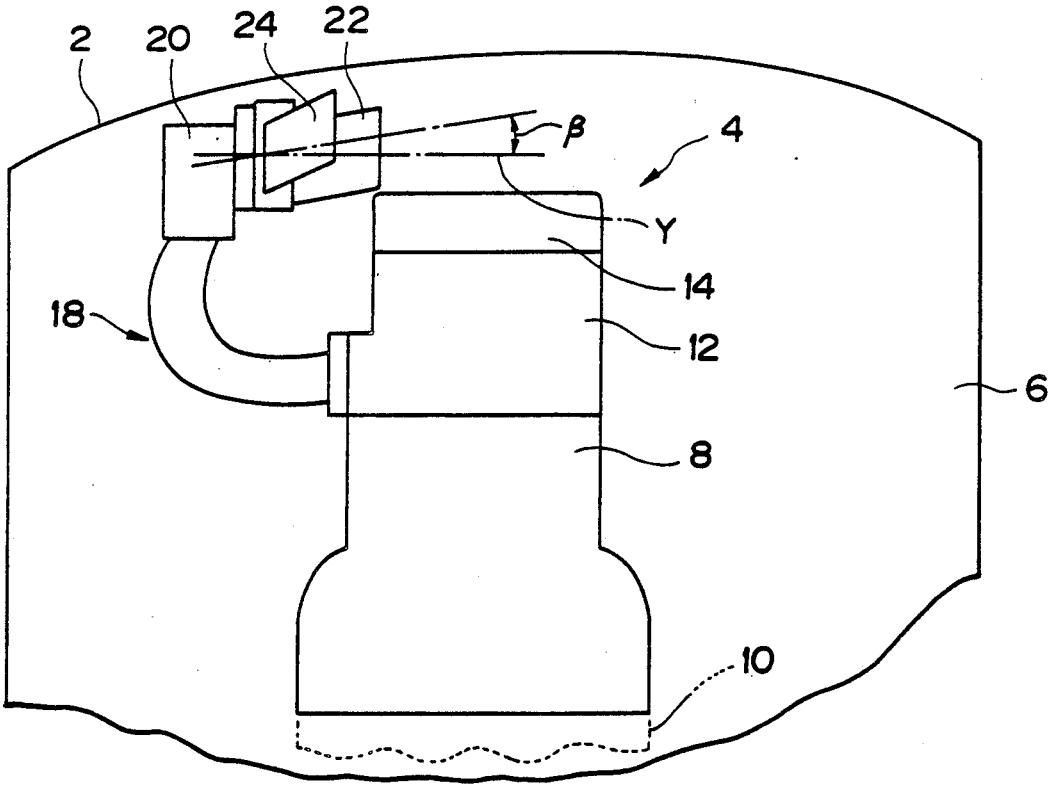
Figure 3:
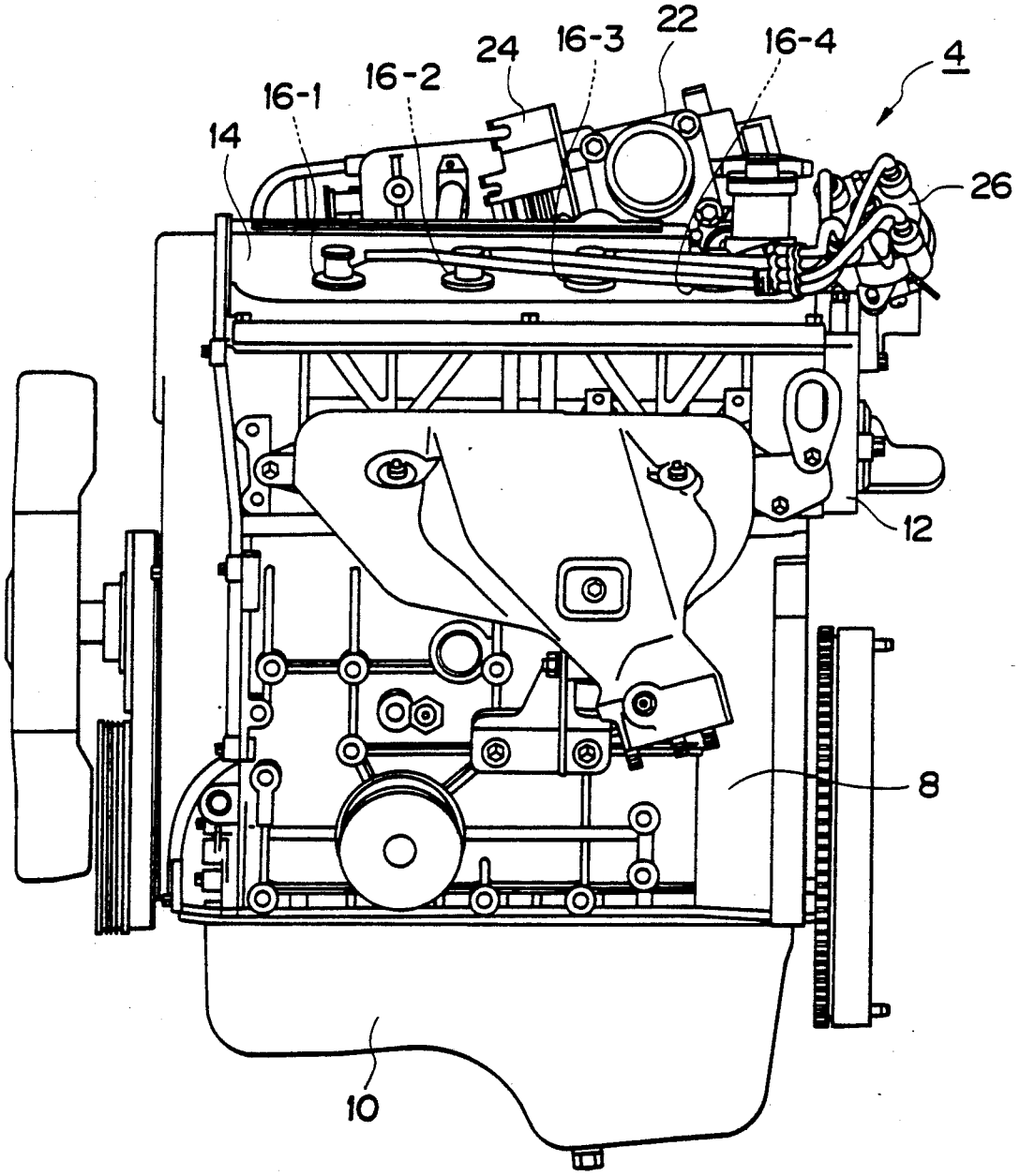
Figure 4:
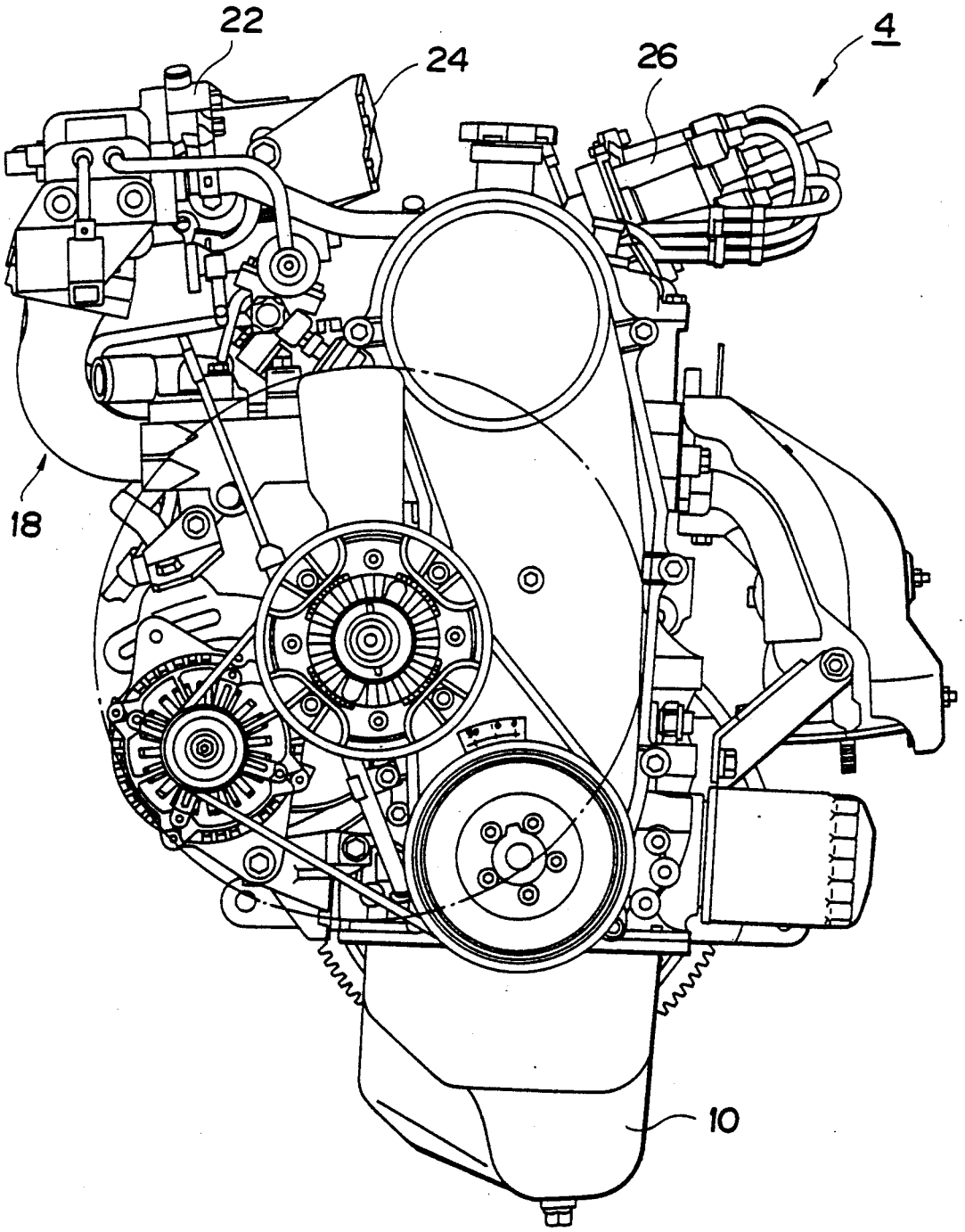
Figure 5:
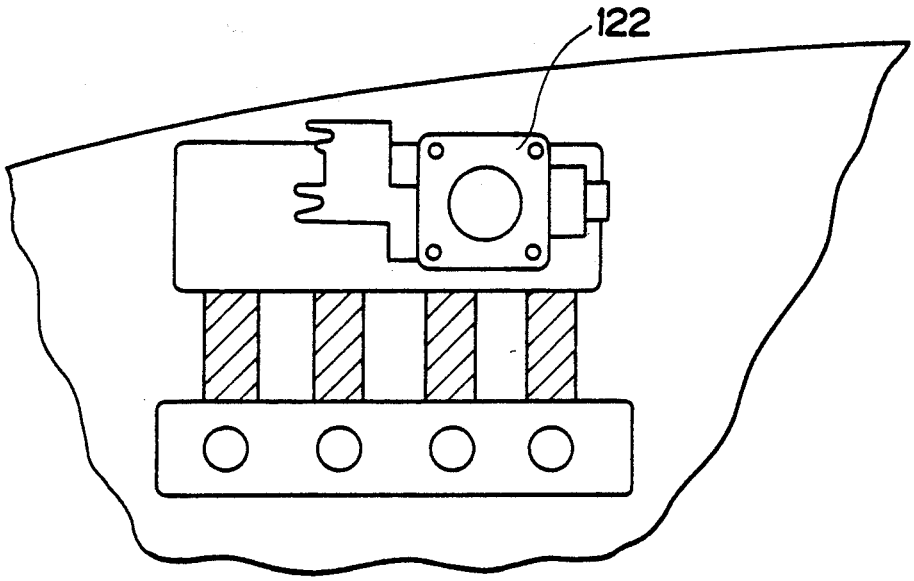
FIG. 5 PRIOR ART
FIG. 5 is a schematic illustration of the configuration of a prior art throttle body.
Figure 6:
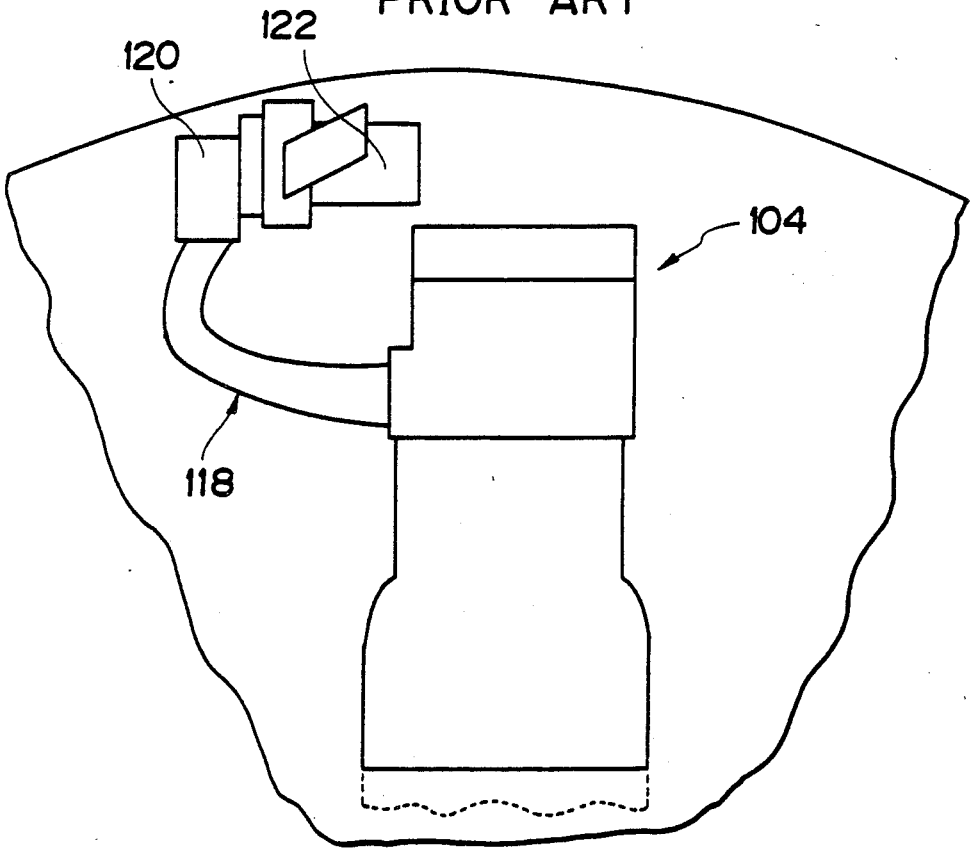
FIG. 6 PRIOR ART
FIG. 6 is a schematic side view of the prior art engine intake structure.

FIGS. 1 to 4 show the preferred embodiment of the invention. In those drawings, 2 is an engine compartment hood of a vehicle, only a fragment of which is shown, and 4 is a vertical engine. The engine 4 is disposed in an engine compartment 6 that is located below the hood 2. An oil pan 10 is attached to the bottom of the engine 4. A cylinder head 12 is attached to the top of a cylinder block 8 of the engine 4. A cylinder head cover 14 is provided at the top of the cylinder head 12. As shown in FIG. 3, the engine 4 has several cylinders, for example, four cylinders numbered from 16-1 to 16-4, in the illustrated embodiment.

The cylinders, 16-1, 16-2, 16-3, and 16-4, are connected respectively to four branch pipes, 18-1, 18-2, 18-3, and 18-4, of an intake manifold 18, as shown in FIG. 1.

A surge tank 20 is provided at a collecting portion on the upstream side of the intake manifold 18. A throttle body 22 is installed upstream of the surge tank 20. An acceleration cable bracket 24 is attached to the throttle body 22, protruding from the side of it.

The throttle body 22 is inclined with respect to the horizontal, both longitudinally and laterally of the vehicle, so that the upper edges of the throttle body 22 and the acceleration cable bracket 24 are substantially parallel to the adjacent portions of the hood 2. This is done to allow the distance (a) (FIG. 1) between the hood 2 and the adjacent upper edge of the acceleration cable bracket 24 to be substantially equal to the distance (b) between the hood 2 and the adjacent upper edge of the throttle body 22.

In more detail, the throttle body 22 in FIG. 1 is inclined downwardly from right to left, or tilted forwardly, wherein the front of the vehicle is to the left. The longitudinal inclination of the throttle body 22 is made at a given angle $\alpha$, for example, ten degrees, relative to a horizontal line (Z) which is parallel to the longitudinal axis of the vehicle (not shown). The throttle body 22 in FIG. 2 is also inclined downwardly from right to left, or tilted sidewardly, toward the side of the vehicle on the left. The lateral inclination of the throttle body 22 is made at a given angle $\beta$, for example, five degrees, relative to a horizontal line (Y) which is parallel to the lateral axis of the vehicle (not shown). In this way, the distance (a) between the hood 2 and the upper portion of the acceleration cable bracket 24 and the distance (b) between the hood 2 and the upper portion of the throttle body 22 can be substantially equal to one another.

Reference numeral 26 identifies the distributor for the engine.

The mode of operation is described next.

The engine 4 is installed in the vehicle (not shown). The throttle body 22 in FIG. 1 is inclined downwardly from right to left. The angle of inclination is made at an angle of only ten degrees relative to the longitudinal axis of the vehicle (not shown). The throttle body 22 in FIG. 2 is inclined downwardly from right to left. The inclination is made at an angle of only five degrees relative to the lateral axis of the vehicle (not shown). In this way, the distance (a) between the hood 2 and the acceleration cable bracket 24 and the distance (b) between the hood 2 and the throttle body 22 are substantially equal to one another.

This makes it unnecessary to change the level of the hood 2 and the attachment level of the surge tank 20. The distance (a) between the hood 2 and the acceleration cable bracket 24 and the distance (b) between the hood 2 and the throttle body 22 can be substantially equal to one another. A satisfactory length of the suction passage (not shown) in the throttle body 22 can be obtained. Thus, this construction is practical and useful.

The ability of providing the satisfactory distance (b) between the throttle body 22 and the hood 2 eliminates the difficulty in placing this throttle body 22. This also allows the space inside the engine compartment 6 to be used effectively, lessening ventilation resistance. Thus, this construction is practical and useful.

As detailed above, the throttle body 22 is inclined relative to the horizontal in both the longitudinal and lateral directions of the vehicle. This is done to allow the distance between the hood and the acceleration cable bracket to be substantially equal to the distance between the hood and the throttle body. The full distance between the hood and the throttle body can be obtained without changing the positions of the hood 2 and the surge tank 20. A satisfactory length of the suction passage in the throttle body 22 can also be provided. Thus, this is practical and useful. The ability of providing a satisfactory distance between the throttle body and the hood eliminates the difficulty in placing the throttle body. This also allows the space near the engine to be used effectively, lessening ventilation resistance. Thus, this is practical and useful.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an engine intake structure of a vertical internal combustion engine disposed in an engine compartment and below the engine compartment hood of a vehicle, said intake structure including a throttle body, an acceleration cable bracket protruding from the side of the throttle body, a surge tank connected downstream of the throttle body and an intake manifold connected downstream of the surge tank, the improvement which comprises; said throttle body is inclined downwardly with respect to the horizontal in a direction toward the front of the vehicle and is also inclined downwardly with respect to the horizontal in a direction toward one lateral side of the vehicle so that the distance between the hood and the acceleration cable bracket is substantially equal to the distance between the hood and the throttle body.

2. An engine intake structure as claimed in claim 1 wherein said throttle body and said acceleration cable bracket have upper edge portions which extend approximately parallel with opposing wall portions of the hood.

* * * * *